US006905269B2

(12) United States Patent
Hansburg

(10) Patent No.: US 6,905,269 B2
(45) Date of Patent: Jun. 14, 2005

(54) SYSTEM AND METHOD FOR CONTINUOUS LABEL PRINTING

(75) Inventor: Edward Michael Hansburg, Wayne, PA (US)

(73) Assignee: Oki Data Americas, Inc., Mt. Laurel, NJ (US)

( * ) Notice: Subject to any disclaimer, the term of this patent is extended or adjusted under 35 U.S.C. 154(b) by 0 days.

(21) Appl. No.: 10/602,284

(22) Filed: Jun. 23, 2003

(65) Prior Publication Data

US 2004/0050273 A1 Mar. 18, 2004

Related U.S. Application Data

(60) Provisional application No. 60/393,609, filed on Jul. 3, 2002.

(51) Int. Cl.[7] ..... B41J 11/26; G03G 15/00

(52) U.S. Cl. ..... 400/621; 399/384

(58) Field of Search ..... 400/621; 156/157, 156/304.1, 304.3, 502; 101/228, 114, 206, 216, 214, 66; 399/228, 384

(56) References Cited

U.S. PATENT DOCUMENTS

| | | | | |
|---|---|---|---|---|
| 3,955,502 A | | 5/1976 | von Hofe | 101/484 |
| 3,963,160 A | | 6/1976 | Bishop | 226/115 |
| 4,177,730 A | | 12/1979 | Schriber et al. | 101/248 |
| 4,242,167 A | * | 12/1980 | Hoffmann | 156/357 |
| 4,276,112 A | | 6/1981 | French et al. | 156/360 |
| 4,347,525 A | | 8/1982 | Moore et al. | 347/157 |
| 4,579,466 A | | 4/1986 | Sato et al. | 400/613 |
| 4,886,680 A | | 12/1989 | Tindall | 427/8 |
| 5,008,710 A | * | 4/1991 | Kobayashi et al. | 399/317 |
| 5,041,850 A | * | 8/1991 | Kahoyashi et al. | 347/157 |
| 5,060,569 A | * | 10/1991 | Gladow | 101/216 |
| 5,194,903 A | | 3/1993 | Negishi et al. | 399/384 |
| 5,201,976 A | | 4/1993 | Eastin | 156/152 |

(Continued)

OTHER PUBLICATIONS

"Print 01: Official eShow Daily: 'Vendors Are Cautiously Optimistic', Chicago, Sep. 9, 2001." <www.eshowdaily-.com/PRINT01/index_9_9.html>.

*Primary Examiner*—Andrew H. Hirshfeld
*Assistant Examiner*—Wasseem H. Hamdan
(74) *Attorney, Agent, or Firm*—Akin Gump Strauss Hauer & Feld, LLP

(57) ABSTRACT

A system for continuous printing is disclosed. The system includes an unwind storing a roll of print media; a cutter which receives the print media and which cuts the print media into sheets of variable length; a sheet printer which receives the sheets of print media from said cutter, prints a design on each of the sheets and outputs printed-on sheets; an edge sensor which detects a leading edge of each of the printed-on sheets when output from said sheet printer; a rewind which receives the printed-on sheets output from said sheet printer; and a controller which receives an output signal from said edge sensor indicating the detection of the leading edge and synchronizes said rewind and the received printed-on sheets to cause a trailing edge and the leading edge of each successive printed-on sheet received by said rewind to be butted one to the other on the rewind.

5 Claims, 1 Drawing Sheet

U.S. PATENT DOCUMENTS

| | | | | | |
|---|---|---|---|---|---|
| 5,274,428 | A | | 12/1993 | Wong et al. | 399/300 |
| 5,401,110 | A | | 3/1995 | Neeley | 400/621 |
| 5,455,668 | A | | 10/1995 | De Bock et al. | 399/299 |
| 5,461,470 | A | | 10/1995 | De Cock et al. | 399/228 |
| 5,472,755 | A | | 12/1995 | Nibling, Jr. | 428/405 |
| 5,499,093 | A | * | 3/1996 | Aerens et al. | 399/228 |
| 5,518,329 | A | | 5/1996 | Beaudry | 400/621 |
| 5,597,642 | A | | 1/1997 | Schleinz et al. | 428/195.1 |
| 5,624,520 | A | | 4/1997 | Nedblake et al. | 156/249 |
| 5,670,005 | A | * | 9/1997 | Look et al. | 156/236 |
| 5,697,297 | A | | 12/1997 | Rasmussen | 101/219 |
| 5,713,679 | A | | 2/1998 | Taylor | 400/621 |
| 5,729,817 | A | * | 3/1998 | Raymond et al. | 399/384 |
| 5,735,659 | A | * | 4/1998 | Kosasa et al. | 412/9 |
| 5,768,675 | A | | 6/1998 | Estabrooks | 399/385 |
| 5,806,432 | A | | 9/1998 | Kurth | 101/488 |
| 5,828,937 | A | | 10/1998 | Aerens et al. | 399/301 |
| 5,893,018 | A | | 4/1999 | De Bock et al. | 399/302 |
| 5,951,182 | A | * | 9/1999 | Van Weverberg et al. | 400/708 |
| 5,961,228 | A | | 10/1999 | Ward et al. | 400/120.16 |
| 6,052,551 | A | | 4/2000 | De Cock et al. | 399/296 |
| 6,085,818 | A | * | 7/2000 | Takizawa et al. | 156/387 |
| 6,129,810 | A | | 10/2000 | Schweitzer et al. | 156/387 |
| 6,148,724 | A | * | 11/2000 | Hart et al. | 101/182 |
| 6,294,038 | B1 | * | 9/2001 | Majkrzak | 156/238 |
| 6,357,941 | B1 | * | 3/2002 | Amano et al. | 60/761 |
| 6,382,092 | B1 | | 5/2002 | Van Den Brink et al. | 101/116 |
| 6,437,814 | B1 | * | 8/2002 | Shimonaga et al. | 347/217 |
| 6,557,795 | B1 | * | 5/2003 | Ohshio et al. | 242/528 |
| 6,633,740 | B2 | * | 10/2003 | Estabrooks | 399/384 |
| 6,712,924 | B2 | * | 3/2004 | Silverbrook | 156/277 |
| 2002/0105570 | A1 | * | 8/2002 | Minowa | 347/102 |
| 2002/0113838 | A1 | * | 8/2002 | Nakajima et al. | 347/37 |
| 2003/0079830 | A1 | * | 5/2003 | Kuller et al. | 156/277 |
| 2003/0089452 | A1 | * | 5/2003 | Hansen et al. | 156/268 |

* cited by examiner

SYSTEM AND METHOD FOR CONTINUOUS LABEL PRINTING

CROSS-REFERENCE TO RELATED APPLICATIONS

This application claims the benefit of U.S. Provisional Application No. 60/393,609 filed Jul. 3, 2002, entitled Continuous Label Printing Apparatus, System and Method, which is hereby incorporated by reference in its entirety.

BACKGROUND OF THE INVENTION

The present invention relates generally to a printing system and, more particularly, to a continuous label printing system utilizing a sheet printer.

Generally, labels are printed by a continuous printing process utilizing a roll label print media. Generally the continuous process for printing labels has been reserved to the flexographic, gravure and thermal printing processes.

Flexographic printing, also known as aniline printing, is a form of relief printing in which a slightly raised image of the label is formed on a printing plate by engraving. In flexographic printing, the raised image is inked and the ink is transferred directly to the print media, typically by a large rotary press. Color labels are printed by passing the print media through the system multiple times. In a four color printing process, the print media is passed through the system four times, once for each of black, cyan, magenta and yellow. Each plate has a high initial cost and has a limited life, requiring periodic replacement. While flexographic systems are efficient at printing very high volumes of labels and/or other documents, flexographic systems also require extensive set-up time (i.e. engraving and replacing the plates) making it cost prohibitive for small runs. Further, flexographic systems are also very large and expensive to purchase. Generally, a print run must be on the order of millions of labels in order for the print run to be cost effective.

Another process for printing labels is known as gravure or rotogravure printing. In gravure printing, the printing area is etched into a surface of a plate or a metal cylinder. In contrast to flexographic printing, the etched out sections are filled with ink and the excess ink on the non-image area is removed by a thin stainless steel blade referred to as a doctor blade. The size and depth of the etched out areas determine how much ink is deposited on the print media. Gravure etched cylinders can cost thousands of dollars. Generally, a print run for a gravure system is on the order of millions of copies in order to be cost effective. Thus, gravure systems suffer from the same drawbacks for a short print run as do flexographic systems.

Thermal printing is a non-impact printing process that uses heat to register an impression on paper. A typical thermal transfer printer has a print head containing many small resistive heating pins that on contact, either melt wax-based ink onto ordinary media or burn dots onto specially coated media. Similar to flexographic printing, thermal printing is usually accomplished through a multi-pass process wherein each color is applied separately. However, thermal-transfer printing systems are not bound by the limits of a printing plate and can rapidly change the image being printed. The major drawback to thermal printing compared to flexographic and gravure printing, is the relatively low quality of the printed image, especially on print media that is not specialty paper. Further, thermal printing equipment is also very expensive to purchase and to maintain as the print heads must be cleaned frequently to remove melted wax or burned-on ink.

What is needed but not provided by the prior art, is a continuous label printing system that allows for just-in-time printing of variable information color images, text and bar codes in small batches without the need for engraved printing plates such as used on flexographic and gravure printing, and which provides a quality equivalent to flexographic and gravure printing. Further, the continuous label printing system should be capable of utilizing print media from a roll and provide the printed-on media in a roll.

BRIEF SUMMARY OF THE INVENTION

Briefly states, the present invention provides a system for continuous printing. The system comprises: an unwind storing a roll of print media; a cutter which receives the print media from said unwind and which cuts the print media into sheets of variable length; a sheet printer which receives the sheets of print media from said cutter, prints a design on each of the sheets and outputs printed-on sheets; an edge sensor which detects a leading edge of each of the printed-on sheets when output from said sheet printer; a rewind which receives the printed-on sheets output from said sheet printer; and a controller which receives an output signal from said edge sensor indicating the detection of the leading edge and, based upon the output signal, synchronizes said rewind and the received printed-on sheets to cause a trailing edge and the leading edge of each successive printed-on sheet received by said rewind to be butted one to the other on the rewind.

The present invention further provides a system for continuous printing. The system comprises: an unwind storing a roll of print media; a cutter which receives the print media from said unwind and which cuts the print media into sheets; a sheet printer which receives the sheets of print media from said cutter, prints a design on each of the sheets and outputs printed-on sheets; and a controller which receives an output signal from said printer and, based upon the output signal, synchronizes said unwind, said cutter and said sheet printer to provide a substantially continuous flow of print media from said unwind to said sheet printer.

The present invention also provides a system for continuous printing. The system comprises: sheet printer which receives sheets of print media and outputs printed-on sheets of the print media; an edge sensor which senses a leading edge of each of the printed-on sheets when output from said printer; a rewind which receives the printed-on sheets output from said printer; and a controller which receives an output signal from said edge sensor indicating the detection of the leading edge and synchronizes, based upon the output signal, said sheet printer and said rewind to cause a trailing edge and the leading edge of each successive printed-on sheet received by said rewind to be butted one to the other on the rewind.

The present invention also comprises a method of continuous printing. The method comprises: feeding sheets of print media to a sheet printer; printing a design on each of the sheets and outputting printed-on sheets; and feeding each of the printed-on sheets to a rewind for storage thereon, wherein said sheet printer and said rewind are synchronized such that leading and trailing edges of successive printed-on sheets received by said rewind are butted one to the other so as to form a roll of print media on the rewind.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
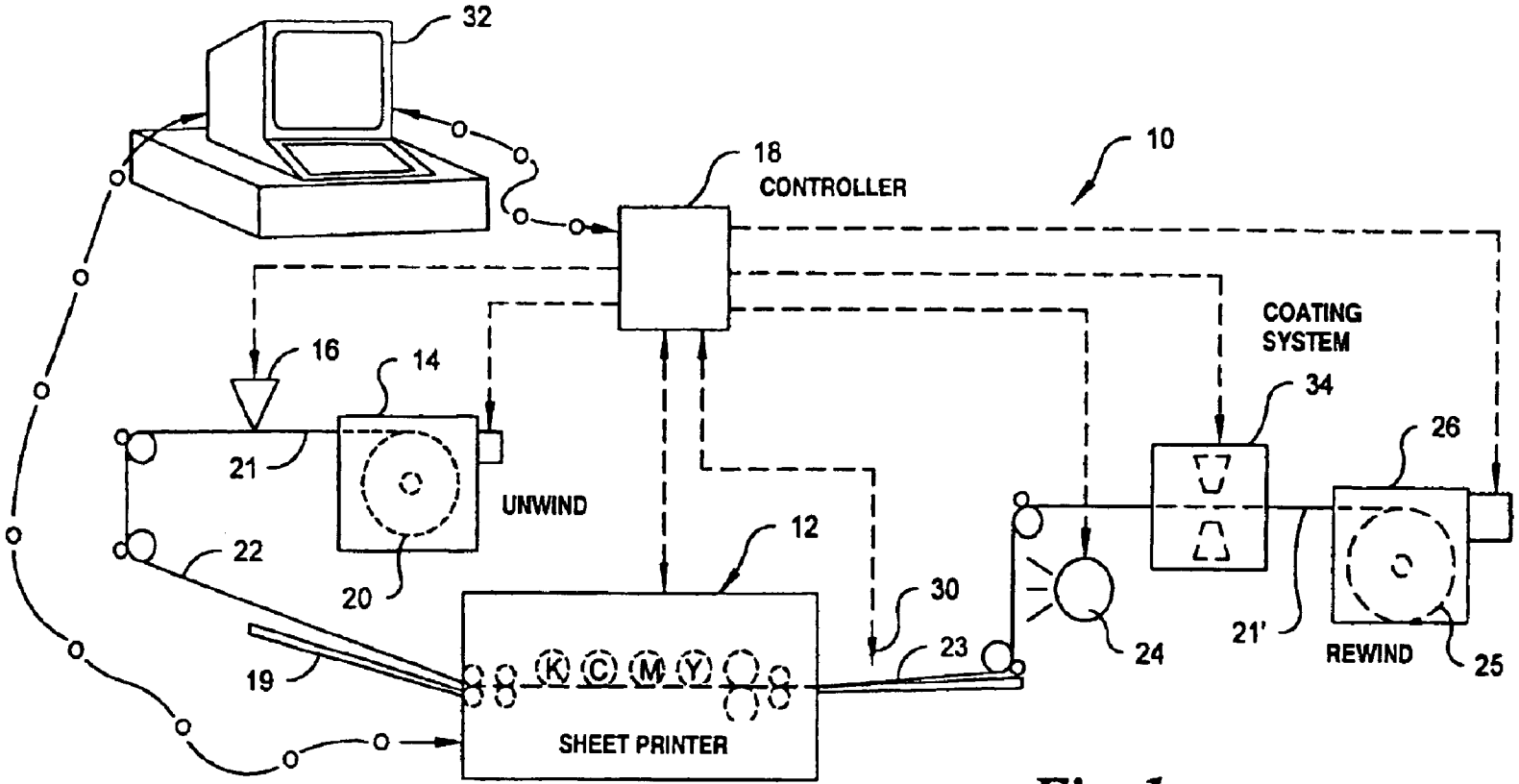
FIG. 1 is a diagram of a continuous label printing system in accordance with a preferred embodiment of the present invention.

Certain terminology is used in the following description for convenience only and is not limiting. The words, "right", "left", "lower", and "upper" designate directions in the drawings to which reference is made. The words "inwardly" and "outwardly" refer to directions toward and away from, respectively, the geometric center of the object discussed and designated parts thereof. The terminology includes the words above specifically mentioned, derivatives thereof and words of similar import. Additionally, the word, "a" as used in the claims, means "one or more than one."

In the drawings, wherein like numerals are used indicate like elements throughout, there is shown in FIG. 1 a diagram of a continuous printing system 10 in accordance with a preferred embodiment of the present invention.

In the preferred embodiment, print media 21 on which labels are to be printed is stored as a roll 20 on an unwind 14. Preferably, the print media 21 comprises blank label stock comprising a paper tape having a dielectric layer on one side and an adhesive layer and a releasable backing layer on the other side. However, the print media 21 may be formed of other materials such as, for example, vinyl or polyester and still be within the spirit and scope of the invention. The label unwind 14 includes all the necessary drives, rollers, motors, gears, pulleys, guides and mounting brackets to unwind the roll 20. Unwinds 14 are well known in the printing art and therefore are not described further, for the sake of brevity.

In the preferred embodiment, the print media 21 is fed from the unwind 14 to a sheet cutter 16. The sheet cutter 16 cuts the print media 21 into separate sheets 22 of variable length depending upon a synchronizing signal from a controller 18 (described below). Cutters 16 for cutting label stock are well known in the printing art and therefore are not described further, for the sake of brevity.

Preferably, the sheets 22 formed by the cutter 16 are dispensed to a sheet printer 12 containing a sheet feeder 19. The sheet feeder 19 provides for temporary storage of the sheets 22. Sheets stored in the sheet feeder 19 are dispensed, one at a time to a print engine in the sheet printer 12 for printing on by the sheet printer 12. While it is preferred that the sheet feeder 19 is integral with the sheet printer 12, a separate sheet feeder is within the spirit and scope of the invention.

Preferably, the sheet printer 12 is capable of receiving and printing on sheets 22 of variable lengths, of printing a unique design on each single sheet 22 and outputting printed-on sheets 23. In the preferred embodiment, the sheet printer 12 is a single-pass color electrophotographic printer, i.e. a printer using the electrophotographic process, capable of printing on sheets 22 of different lengths at least as long as 47.24 inches. Printers having the aforementioned characteristics are manufactured by Okidata Corporation as the series C9300/9500, C7300/C7500 and C5100/C5300 printers. However, as would be clear to those skilled in the art, it is not necessary for the sheet printer 12 to be able to print on sheets of different lengths or on lengths greater than standard letter size. Further, the present invention is not limited to using a color electrophotographic printer. The printer 12 could be, for instance, an ink jet printer, a bubble-jet printer, or an impact printer such as a dot matrix printer, and could be a black and white printer, and still be within the spirit and scope of the invention.

The preferred embodiment further includes a sensor 30 for detecting a leading edge of each of the printed-on sheets 23 when output from the sheet printer 12. The sensor 30 may be an opto-electric device such as a photo-diode, a mechanical device, an electromechanical device or a combination thereof capable of edge detection. In the preferred embodiment, the sensor 30 is a photo diode and accompanying electronic circuitry. The sensor 30 provides an output signal to the controller 18 which indicates a time signifying detection of the leading edge of each printed-on sheet 23 by the sensor 30.

The preferred embodiment of the printing system 10 also includes a rewind 26 which receives the printed-on sheets 23 output from the sheet printer 12 and stores the printed-on sheets 23 as a roll 25 such that the leading and trailing edges of each successive printed-on sheet 23 received by the rewind 26 are butted one to the other. The rewind 26 includes all the necessary drives, rollers, motors, gears, pulleys, guides and mounting brackets to form the roll 25 of the printed-on sheets 23 on the rewind 26. Rewinds 26 are well known in the printing art and therefore are not described further, for the sake of brevity.

In the printing system 10, the time for printing an image on each individual sheet 22 in the sheet printer 12 may vary from sheet 22 to sheet 22. In the preferred embodiment, in order that the sheet feeder 19 not be over or under run by the sheets 21 received from the cutter 16, and for the printing system 10 to abut the printed-on sheets 23 in roll form 25 on the rewind 26, operation of the unwind 14, the cutter 16, the printer 12, and the rewind 26 are synchronized. In the preferred embodiment, the output signal from the sensor 30 is provided to the controller 18 for synchronizing the unwind 14, the cutter 16, the printer 12 and the rewind 26.

The controller 18 synchronizes the unwind 14, the cutter 16 and the printer 12 such that the print media 21 is drawn from the unwind 14 at a rate which can be cut and processed by the cutter 16, the printer 12 and the rewind 26 to provide a substantially continuous flow of print media from the unwind 14 to the printer 12 without an excessive over or under run of the sheets 22 in the sheet feeder 19. Preferably, the controller 18 synchronizes the unwind 14, the cutter 16, and the printer 12 by commanding the unwind 14 to feed a desired length of print media 21 to the printer 12. At the moment the desired length of print media 21 passes a blade of the cutter 16, the controller 18 commands the cutter 16 to cut the print media 21 to form a sheet 22 of the desired length, which sheet 22 is then deposited in the sheet feeder 19. The controller 18 then commands the printer 12 draw the sheet 22 from the sheet feeder 19 and to print an image on the sheet 22. If a successive sheet is to be printed upon, the controller 18 commands the unwind 14 to feed another desired length of print media to the printer 12 based upon the receipt of the output signal from the sensor 30, and so on.

The controller 18 also controls the rewind 26 to cause the trailing edge and leading edge of each successive printed-on sheet 23 output from the printer 12 and received by the rewind 26 to be butted one to the other on the rewind to form a roll 25 of virtually continuous printed-on media 21' on the rewind 26. The output of the sensor 30 synchronizes the revolution of the rewind 26 with the leading edge of each printed-on sheet 23 by utilizing the outputs signal from the sensor 30 which indicates that the leading edge of the printed-on sheet 23 is concurrent with the sensor 30. In the preferred embodiment, the revolution of the rewind 26 is made discontinuous, i.e., the instantaneous position of the rewind 26 is adapted to cause the leading and trailing edges of each successive printed-on sheet 23 to abut as the printed-on sheets are wound on the rewind 26. Alternatively, the rewind 26 could operate at a generally fixed revolution rate, and the timing of the feed of the printed-on media 23 to the rewind 26 could be adjusted.

In addition, to receiving the edge detecting signal from the edge detector 30, the controller 18 accepts signals from the unwind 14, the cutter 16, the printer 12 and the rewind 26. Such signals are, for example, indicative of the positions of the unwind 14, rewind 26 and the print media 21 and the operability status of the unwind 14, the cutter 16, the printer 12 and the rewind 26.

The controller 18 is based upon a computer of conventional design. In the preferred embodiment the controller 18 and a corresponding computer program are incorporated into an existing computer within the printer 12. Alternatively, the controller 18 may be a separate computer within the printer 12; or incorporated into the unwind 14, the cutter 16, or the rewind 26; or be a separate computer such as a personal computer (PC) or an industrial controller.

In addition to synchronizing the unwind 14, the cutter 16, the printer 12 and the rewind 26, the controller 18 also receives the images to be printed on the print media 21 from an external equipment 32 such as a computer and forwards the print images to the print engine of the sheet printer 12. The electrical interface for interfacing the controller 18 to the external equipment could utilize any one of a number of communication means such as, for example, Ethernet, IEEE-1284, and universal serial bus (USB). In addition to receiving images from the external equipment 32, the controller 18 also interchanges control and status data with the external equipment 32.

Optionally, the label printing system 10 also includes a sheet binder 24 interposed between the sheet printer 12 and the rewind 26. The sheet binder 24 binds or attaches successive printed-on sheets 23 into a continuous roll 25 on the rewind. In the preferred embodiment, the sheet binder 24 attaches the successive sheets with an adhesive. However, the sheet binder 24 could also attach the sheets 23 by other means, such as welding, stitching, taping within the spirit and scope of the invention.

Optionally, the printing system also includes a coating system 34 for coating the fronts or the backs of the printed-on sheets 23 with glue, polymeric material, clear coat film and the like for attachment of the print media 21 onto packages or for protection of the ink deposited on the print media 21.

In a second preferred embodiment, the printing system is configured to directly utilize the print media 21 in the form of sheets 22 of variable length. The sheets 22 may be received by the sheet feeder 19, or may be received from one or more trays within the printer 12 after being manually loaded into the trays.

In a third preferred embodiment, the printing system 10 is configured for feeding the print-on sheets 23 directly to a labeling system (not shown) instead of to the rewind 26. When configured for feeding the printed-on sheets 23 to the labeling system, the printed-on sheets 23 are supplied directly to the labeling system after passing the sheet binder 24. Desirably, the labeling system may include rollers, cutters, joiners, applicators and the like for directly placing the labels onto product packages such as bottles, cans, boxes, cases and the like.

From the foregoing it can be seen that the present invention comprises a system and method for continuous, just-in-time, short run printing of variable image labels, on print media from a roll, utilizing a sheet printer. However, as would be appreciated by those skilled in the art, the present invention is not limited to printing labels from roll media. The present invention can also be used for printing signs, banners, tags etc. and can utilize print media other than roll media, such as card stock, waterproof and UV resistant synthetics, fan-fold continuous forms etc.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A system for continuous printing, the system comprising:

a sheet printer which receives sheets of print media and outputs printed-on sheets of the print media;

an edge sensor which senses a leading edge of each of the printed-au sheets when output from said printer;

a rewind which receives the printed-on sheets output from said printer; and a controller which receives an output signal from said edge sensor indicating the detection of the leading edge and synchronizes, based upon the output signal, said sheet printer and said rewind to cause a trailing edge and the leading edge of each successive printed-on sheet received by said rewind to abut one to the other on the rewind.

2. The system according to claim 1, further including a sheet binder interposed between said sheet printer and said rewind, wherein said sheet binder attaches the leading and trailing edges of the successive sheets one upon the other.

3. The system according to claim 1, wherein said sheet printer is an electrophotographic printer.

4. The system according to claim 1, further including a cutter which forms the sheets of print media by cutting one of roll, fan-fold or card stock media.

5. The system according to claim 1, wherein said sheet printer is capable of printing on sheets at least as long as about 47 inches.

* * * * *